US007647729B2

(12) United States Patent
Polus

(10) Patent No.: US 7,647,729 B2
(45) **Date of Patent: *Jan. 19, 2010**

(54) SLIDING DOOR SYSTEM

(76) Inventor: Doron Polus, 7769 Lemona Ave., Van Nuys, CA (US) 91405

( * ) Notice: Subject to any disclaimer, the term of this patent is extended or adjusted under 35 U.S.C. 154(b) by 199 days.

This patent is subject to a terminal disclaimer.

(21) Appl. No.: 11/521,237

(22) Filed: Sep. 14, 2006

(65) Prior Publication Data

US 2007/0062122 A1 Mar. 22, 2007

Related U.S. Application Data

(60) Provisional application No. 60/718,114, filed on Sep. 16, 2005.

(51) Int. Cl.
*E05D 13/00* (2006.01)

(52) U.S. Cl. ..... 49/425; 49/411; 49/404

(58) Field of Classification Search ..... 49/404, 49/409, 410, 411, 425, 426, 413, 501, 57; 4/557, 607

See application file for complete search history.

(56) References Cited

U.S. PATENT DOCUMENTS

| | | | | | |
|---|---|---|---|---|---|
| 302,628 | A | | 7/1884 | Fleming | |
| 313,085 | A | | 3/1885 | Lawrence | |
| 343,368 | A | | 6/1886 | Gansz | |
| 472,110 | A | | 4/1892 | Eckerson | |
| 814,434 | A | | 3/1906 | Dahlund | |
| 873,816 | A | | 12/1907 | Wideman et al. | |
| 1,041,446 | A | | 10/1912 | Dolph | |
| 1,360,777 | A | * | 11/1920 | Murphy | 49/426 |
| 1,875,965 | A | | 9/1932 | Waters | |
| 2,650,387 | A | | 9/1953 | Foss | |
| 2,834,069 | A | | 5/1958 | Perrone | |
| 3,033,285 | A | * | 5/1962 | Banner | 49/425 |
| 3,058,173 | A | * | 10/1962 | Brydolf | 49/411 |
| 3,058,174 | A | * | 10/1962 | Sterling | 49/372 |
| 3,533,190 | A | * | 10/1970 | Johnson et al. | 49/501 |
| 3,693,293 | A | | 9/1972 | Egan, Jr. et al. | |
| 3,750,337 | A | * | 8/1973 | Brydolf et al. | 49/411 |
| 4,123,874 | A | * | 11/1978 | Scott | 49/411 |
| 4,193,500 | A | * | 3/1980 | Scott | 206/577 |
| 4,288,887 | A | * | 9/1981 | Johnson et al. | 16/105 |
| 4,561,210 | A | * | 12/1985 | Kvas et al. | 49/372 |
| 4,672,712 | A | | 6/1987 | Stevenson | |
| 4,722,150 | A | * | 2/1988 | Jacobs et al. | 49/425 |
| 4,819,297 | A | * | 4/1989 | Jacobs et al. | 16/87 R |
| 4,850,145 | A | * | 7/1989 | McAfee | 49/501 |

(Continued)

*Primary Examiner*—Katherine W Mitchell
*Assistant Examiner*—Catherine A Kelly
(74) *Attorney, Agent, or Firm*—Pillsbury Winthrop Shaw Pittman LLP

(57) ABSTRACT

A sliding door system includes a sliding door having an upper roller assembly disposed atop a portion of the door's frame, a lower wheel assembly disposed at a bottom portion of the frame, a channeled upper track, a lower track having at least one convex longitudinal rail configured to receive the lower wheel assembly, and one or more optional panel divider strips. The lower wheel assembly includes a vertical spine having a transverse shaft coupled to a bottom portion thereof, a lower wheel that has a concave contact surface and is rotatably coupled to the transverse shaft, and a transverse latch member disposed vertically below the lower wheel to slidably latch the lower wheel assembly to the lower track as the lower wheel rotates matingly on the convex longitudinal rail.

9 Claims, 8 Drawing Sheets

U.S. PATENT DOCUMENTS 5,119,872 A * 6/1992 Engebretson ..... 160/381
5,349,783 A 9/1994 Jasperson et al.
5,555,923 A * 9/1996 Leist et al. ..... 160/229.1
5,575,321 A * 11/1996 Currier ..... 160/90
5,598,606 A * 2/1997 Jacobs ..... 16/93 R
5,598,666 A * 2/1997 Kurth ..... 49/409
5,671,502 A * 9/1997 Ezman ..... 16/105
5,724,770 A * 3/1998 McAfee ..... 49/409
5,742,979 A 4/1998 Garcia-Hernando
5,791,089 A * 8/1998 Prevot et al. ..... 49/425
5,836,111 A * 11/1998 Tak ..... 49/425
5,927,017 A * 7/1999 Jacobs et al. ..... 49/410
5,964,061 A * 10/1999 Hughes et al. ..... 49/425
5,974,738 A 11/1999 Jacobs
6,065,249 A * 5/2000 Gephart et al. ..... 49/425
6,142,082 A * 11/2000 Burke et al. ..... 105/377.09
6,148,896 A * 11/2000 Pinto et al. ..... 160/229.1
6,434,789 B1 8/2002 Kruse
6,449,906 B1 * 9/2002 Jacobs ..... 49/409
6,584,664 B2 * 7/2003 Hostetler et al. ..... 29/402.01
6,826,867 B1 12/2004 McDonald et al.
6,840,009 B2 1/2005 Ronay et al.
6,851,743 B2 2/2005 George et al.
6,860,078 B1 3/2005 Geisthardt
7,021,007 B2 * 4/2006 Jacobs ..... 49/425
7,059,017 B1 6/2006 Rosko et al.
2005/0000164 A1 * 1/2005 Jacobs ..... 49/425
2007/0017157 A1 * 1/2007 Ambrozus ..... 49/425

* cited by examiner

SLIDING DOOR SYSTEM

RELATED APPLICATION DATA

This application claims the benefit of provisional application Ser. No. 60/718,114, filed Sep. 16, 2005, which is incorporated by reference herein in its entirety.

FIELD OF INVENTION

This invention relates generally to sliding door systems and, more particularly, to sliding doors, windows, mirrors, etc. that include upper roller and lower wheel assemblies that provide not only a smooth and quiet glide, but also a safety mechanism to ensure that the sliding door, window, mirror, etc. remains on its track.

BACKGROUND OF THE INVENTION

Every sliding door usually has an upper track and a lower track. The majority of the weight of each door is carried by the lower track. As such, the upper track is generally designed in such a way as to guide the door so as to keep it in line and in place. As a result, the upper part of the door is usually looser, and typically creates undesirable noises caused by the friction between the upper part of the door and portions of the upper track.

In addition, it is important to ensure that sliding doors always remain in their tracks. Disengagement of a sliding door (or window, mirror, etc.) from its tracks is problematic for at least two reasons. First, the door, or portions thereof, might fall and break, thereby requiring costly repair or replacement. Second, and more importantly, a disengaged sliding door presents a significant health hazard not only to the individual operating the door, but also to any bystanders in the vicinity of the door.

Moreover, existing sliding doors provide little or no flexibility based on their functionality. More specifically, it may be desirable to customize a sliding door based on the door's intended function. Thus, for example, if the door is intended to function as a room divider, it may be desirable to have a "one-piece" panel design. On the other hand, if the sliding door is meant to be a sliding mirror or glass door for a closet, it may be desirable for the panel to be multi-faceted, e.g., have multiple horizontal or vertical panel designs.

With existing systems, the only way to achieve such function-based designs is to manufacture the door with multiple panels cut to produce the desired shapes and angles. Thus, in order for a glass door to appear as if it has three horizontal sections, for example, the door would have to be manufactured with three pieces of glass fitted within a frame that includes four horizontal frame members. This practice, however, requires that each and every sliding door be custom-made, thereby making it labor- and cost-intensive. In addition, once a door has been custom-made, the only way for a different design to be achieved—e.g., four horizontal sections instead of three—would be for another door to be custom made with the new specifications, thereby rendering the old door useless.

What is needed, therefore, is a sliding door system that allows the door to slide back and forth smoothly without any obstacles, interruptions, or undesirable noises, prevents disengagement of the door from its tracks, and allows for repeated customization without the requirement of manufacturing a new, custom-made door each time.

DETAILED DESCRIPTION

In light of the above-mentioned need, the instant invention is directed to a sliding door system that provides a smooth and quiet glide, a safety mechanism to ensure that the sliding door remains on its track, and a means for effecting design flexibility in a time- and cost-efficient manner.

It is noted that, although, throughout the ensuing discussion, reference is made to a sliding "door", such reference is made by way of illustration, and not limitation. Thus, the instant invention encompasses sliding structures that may be used as doors (e.g., closet doors); room dividers; (wall) pocket doors, where the sliding "door" extends from, and retracts into, a wall cavity; wall sliders, where lower and upper tracks are placed next to a wall, such that the sliding "door" slides back and forth from behind the wall; etc. In addition, the term "door" is used herein generically and without limitation as to the material of which the door's panel is made. Thus, the panel may be made of clear glass, milky glass, frosted glass, mirror, etc., and combinations thereof.

Figure 1:
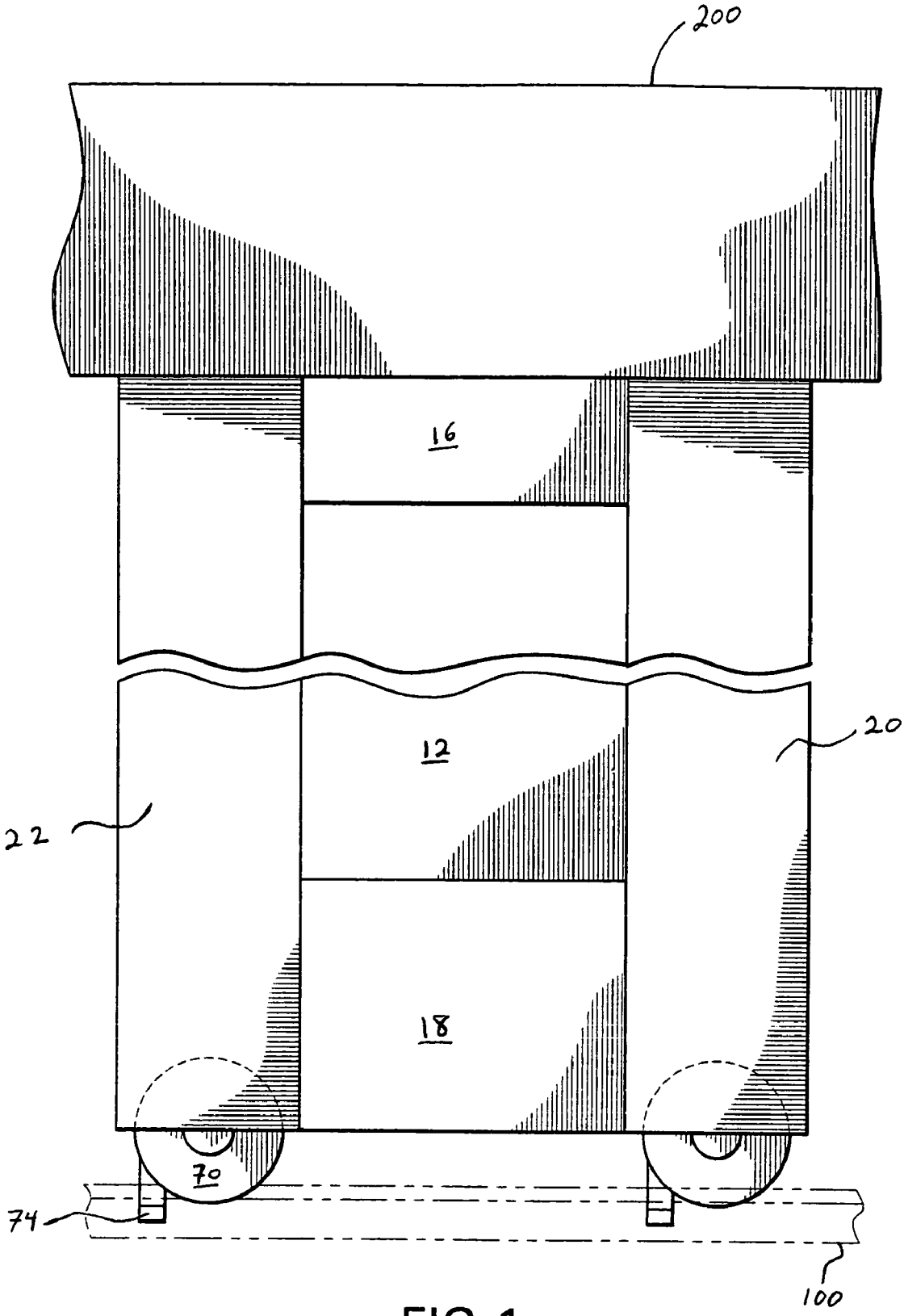
FIG. 1 shows a frontal view of a sliding door system in accordance with an embodiment of the invention.
Figure 2:
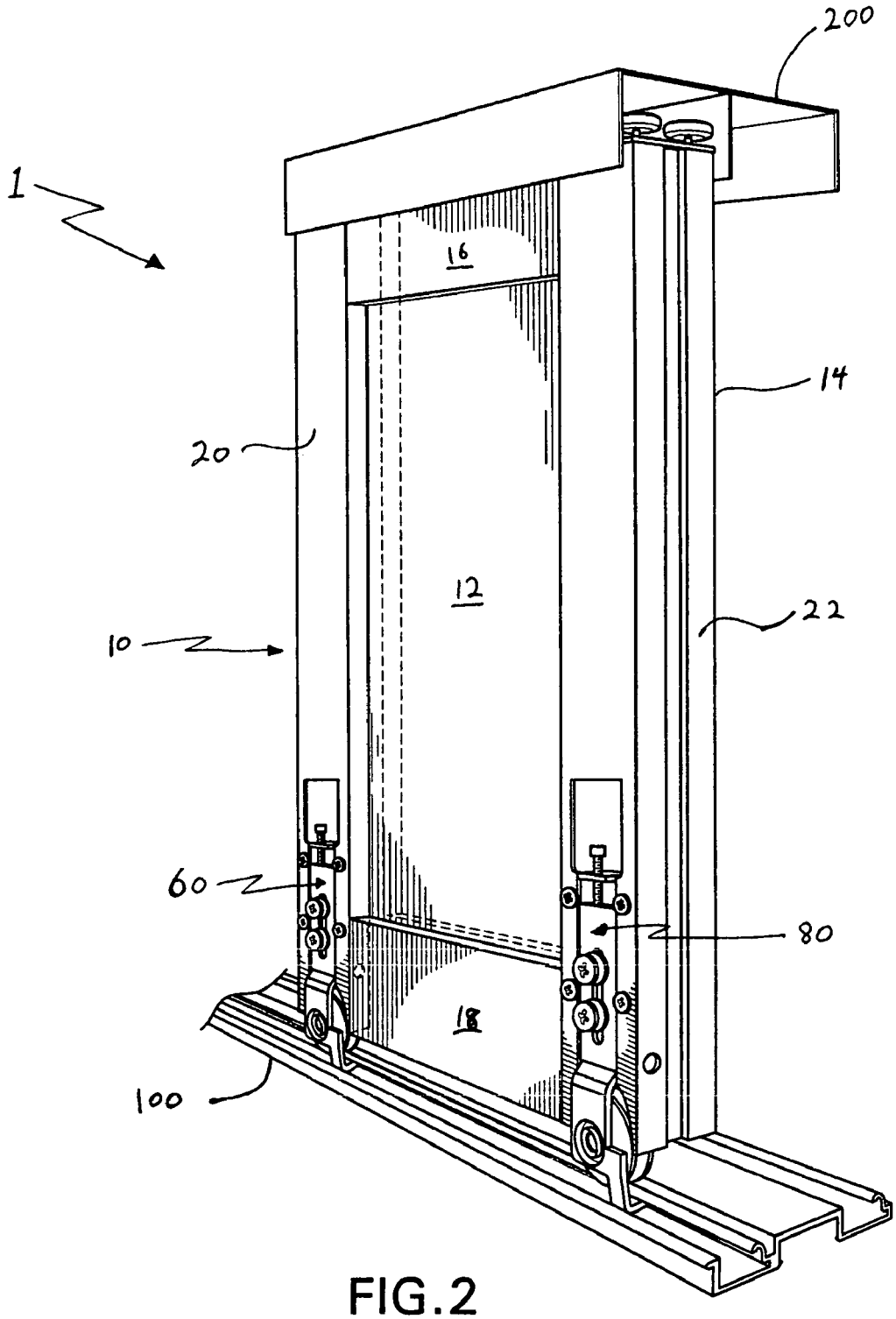
FIG. 2 shows a sliding door, an upper track, and a lower track in accordance with an embodiment of the invention.

FIGS. 1 and 2 show a sliding door assembly 1, including a door 10, a lower track 100, and an upper track 200. The door 10 includes a panel 12 encased within a frame 14 which comprises a horizontal top portion (or member) 16, a horizontal bottom portion 18, a first vertical side portion 20, and a second vertical side portion 22. As shown, opposing horizontal members 16 and 18 are vertically spaced apart from one another, and opposing vertical members 20 and 22 are horizontally spaced apart from one another. In embodiments of the invention, the members 16, 18, 20, 22 may be made of aluminum. In addition, in embodiments where the panel 12 is made of glass, the glass may be tempered, and have a thickness of at least 4.0 mm, and more preferably, a thickness of at least 5.0 mm.

As shown in FIGS. 2-5, in a preferred embodiment, the door 10 includes at least one upper roller assembly 40 and one lower wheel assembly 60. The upper roller assembly 40 is coupled to an upper part of the frame 14 that is proximate the horizontal top portion 16, and the lower wheel assembly 60 is coupled to a lower part of the frame 14 that is proximate the horizontal bottom portion 18. Preferably, for each door 10, one upper roller assembly 40 is disposed atop each of the vertical side portions 20, 22, and one lower wheel assembly 60, 80 is disposed at the bottom of each of the vertical side portions 20, 22.

Figure 3:
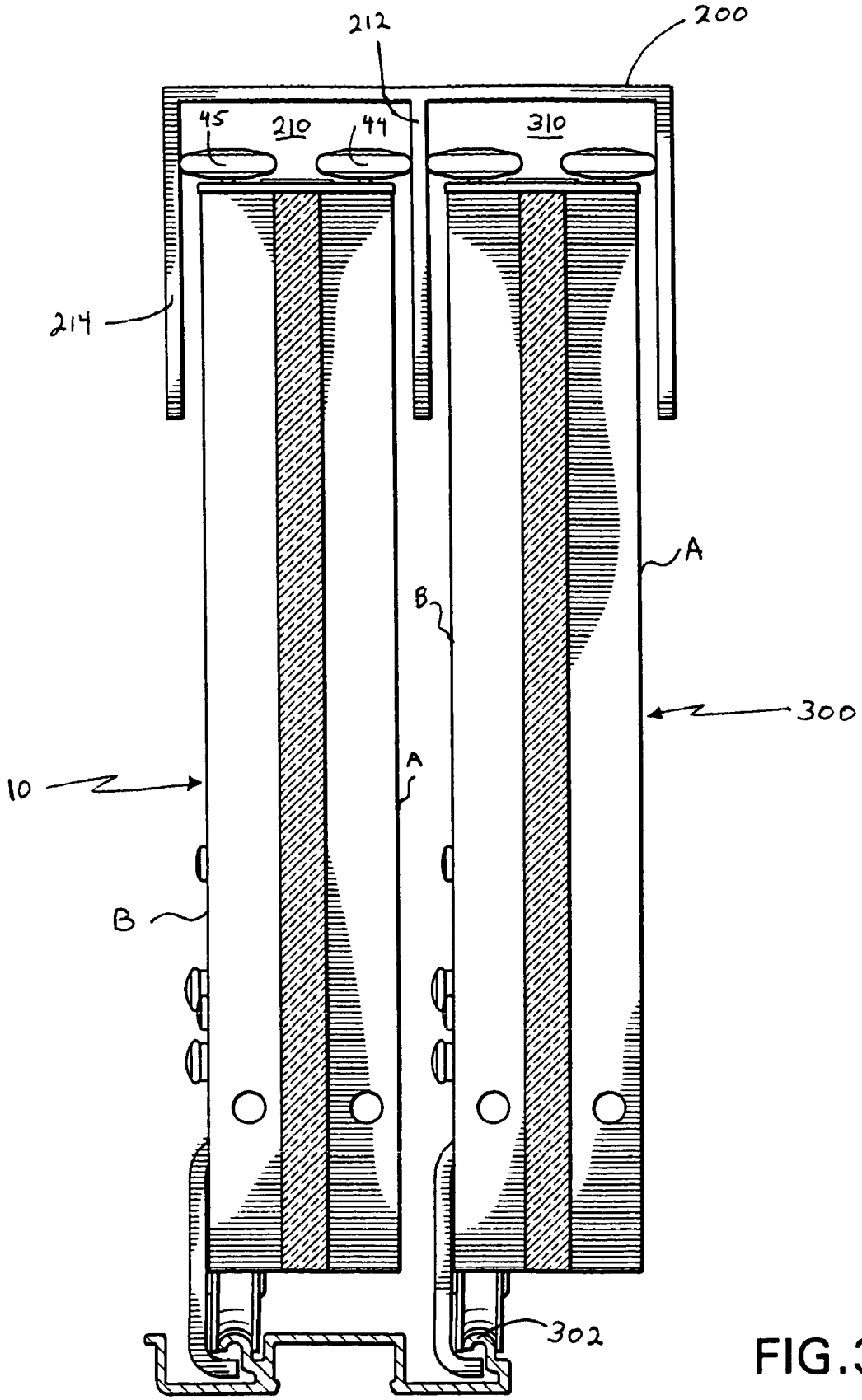
FIG. 3 shows a side view of two doors, an upper track, and a lower track in accordance with an embodiment of the invention.
Figure 4:
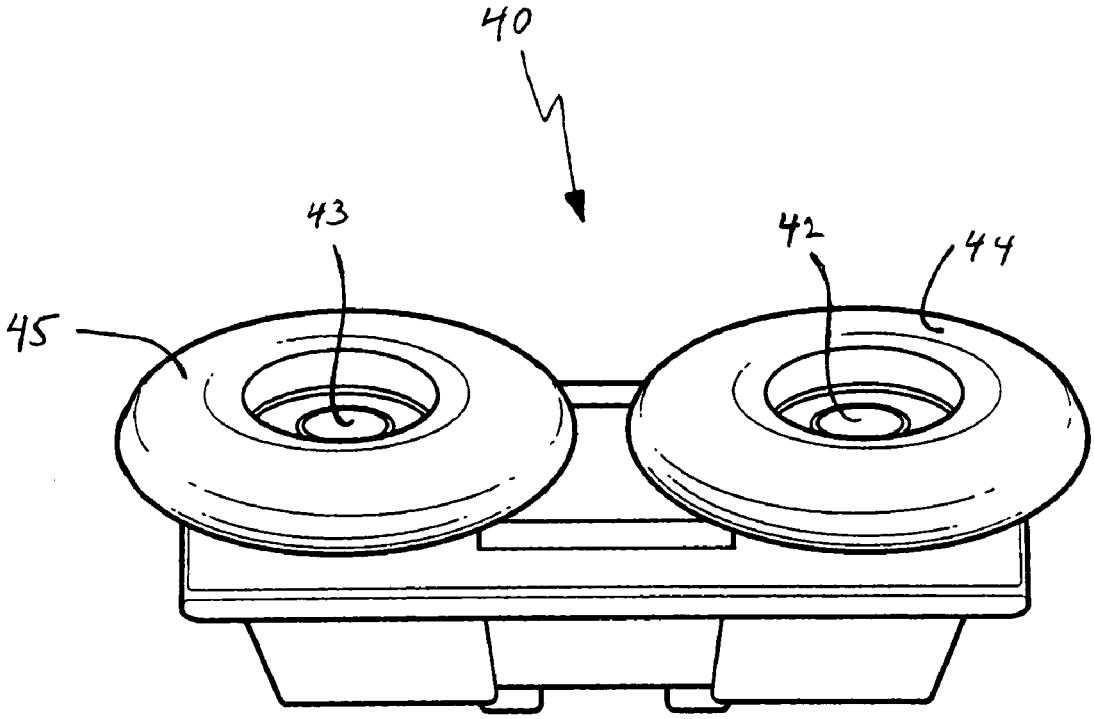
FIG. 4 shows an upper roller assembly according to an embodiment of the invention.

The upper roller assembly 40 includes first and second rollers 44, 45 that are rotatably mounted on respective first and second vertical shafts 42, 43. With reference to FIG. 3, the first shaft 42 is disposed adjacent the front side A of the frame 14, and the second shaft 44 is disposed adjacent the back side B of the frame 14. In this way, the periphery of the first roller 44 extends beyond the plane of the frame's (and door's) front side A, and the periphery of the second roller 45 extends beyond the plane of the frame's (and door's) back side B.

The above configuration is significant because it allows the door 10 to be stable and slide smoothly without any frictional contact between the upper track 200 and the door 10. Specifically, the upper track 200 defines at least one channel 210 having first and second opposing side walls 212, 214. As shown in FIG. 3, the first side wall 212 extends downwards over, and parallel to, the front side A of the frame's horizontal top portion, and the second side wall 214 extends downwards over, and parallel to, the back side B of the frame's horizontal top portion. As noted above, the combined span of the rollers 44, 45 extends beyond the width of the frame 14. As such, in operation, the first roller 44 rotates in frictional contact with an inner surface of the first side wall 212, and the second roller 45 rotates in frictional contact with an inner surface of the second side wall 214, thereby eliminating any frictional contact between the frame 14 and the side walls 212, 214.

It is noted that, in a preferred embodiment, the combined span of the rollers 44, 45 is slightly larger than the horizontal distance between the respective inner surfaces of the side walls 212, 214, and rollers 44, 45 are made of flexible rubber, so as to provide for a snug fit between the rollers 44, 45 and the side walls 212, 214. In addition, in embodiments of the invention, one or both of the side walls 212, 214 may extend far enough downwards to completely cover (the front side A, and/or the back side B, respectively, of) the horizontal top portion 16 of the frame 14.

Figure 5:
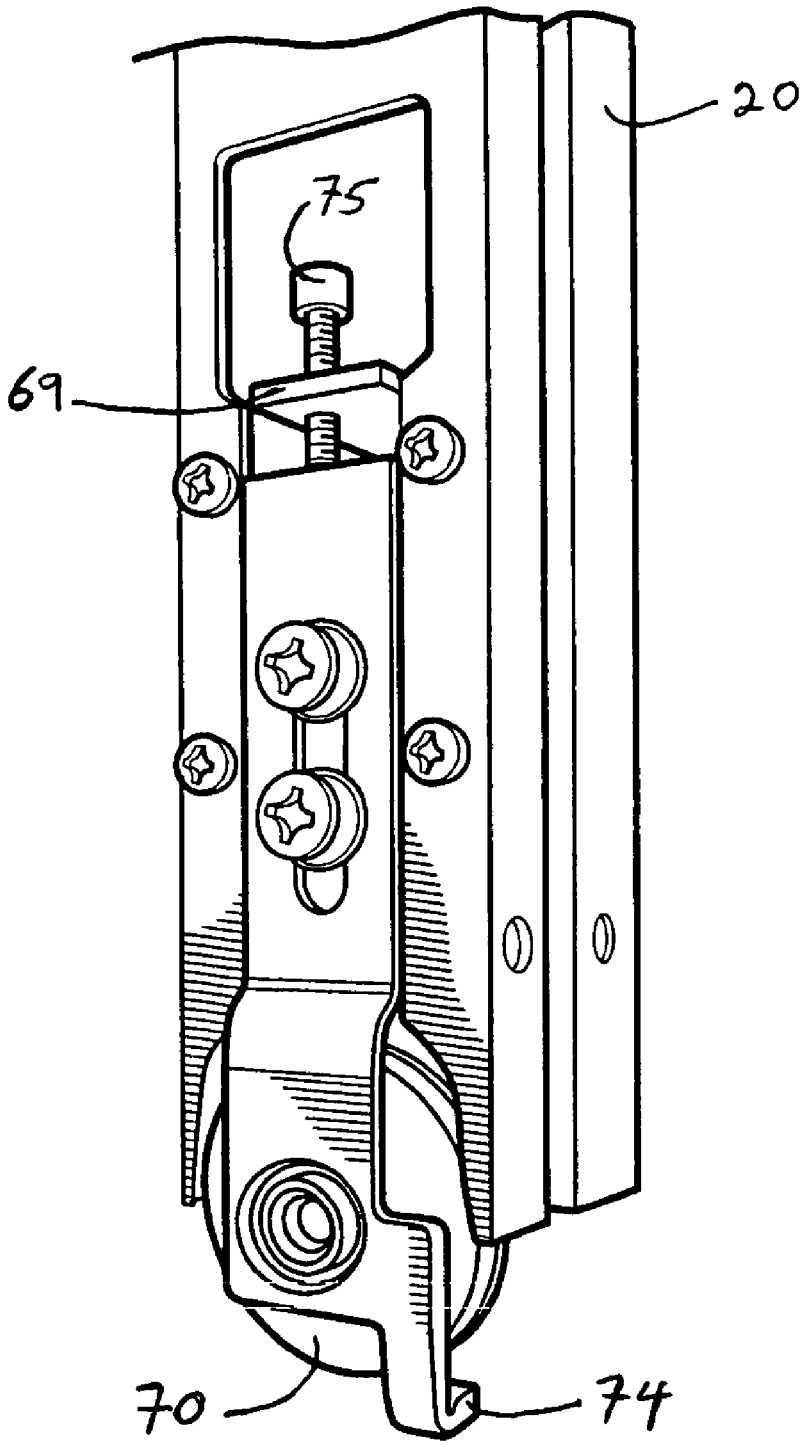
FIG. 5 shows a lower wheel assembly according to an embodiment of the invention.
Figure 6:
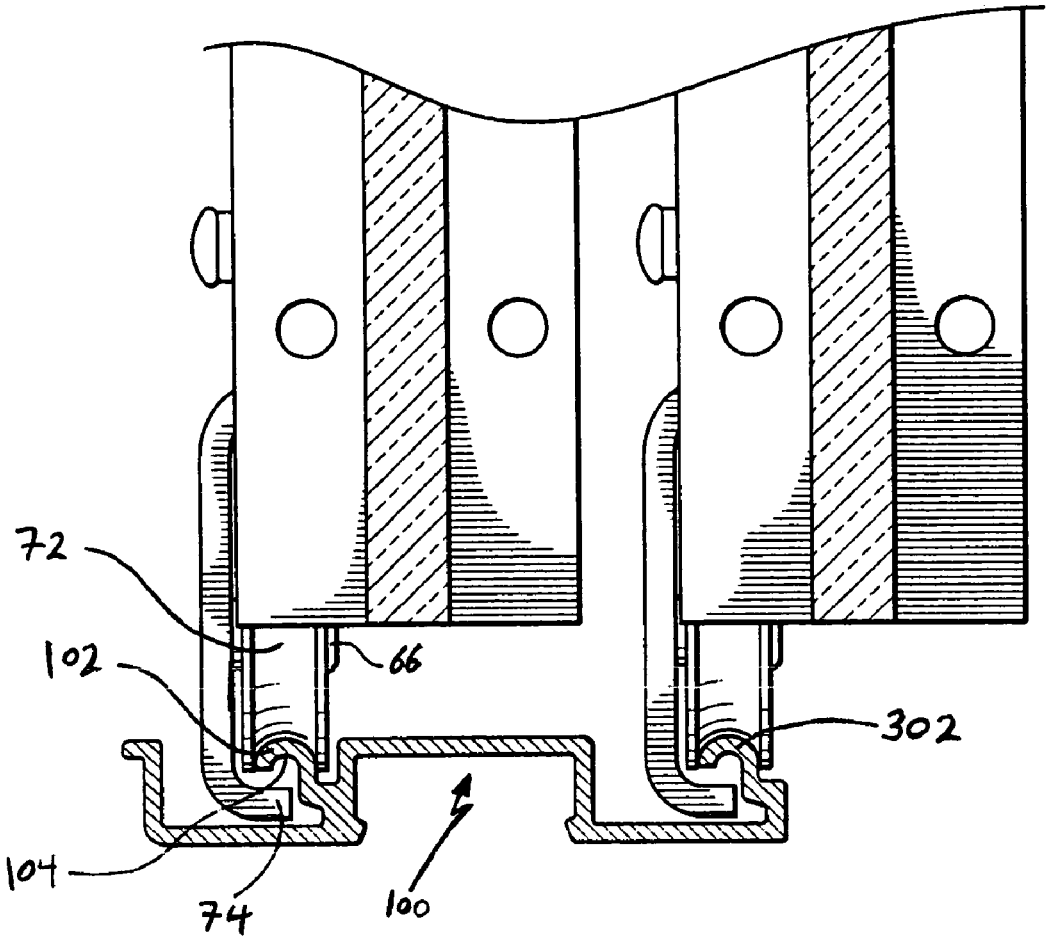
FIG. 6 shows an enlarged view of two sliding doors engaging a lower track in accordance with an embodiment of the invention.
Figure 7:
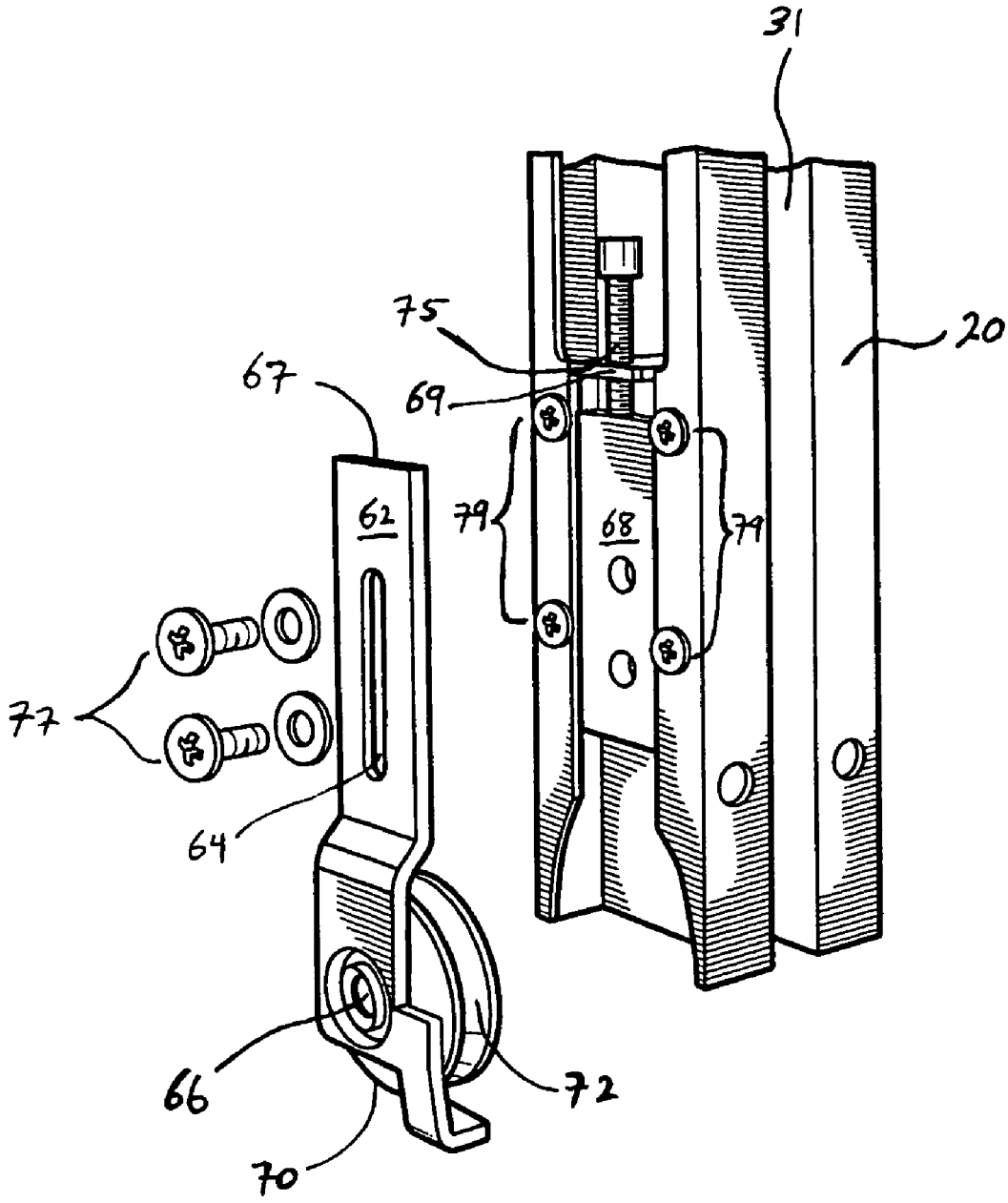
FIG. 7 shows an exploded view of a lower wheel assembly according to an embodiment of the invention.

FIGS. 5-7 show details of the lower wheel assembly 60 and the lower track 100. In a preferred embodiment, the lower wheel assembly 60 includes a vertical spine 62 which, in turn, has a vertical slot 64 through its central portion. The vertical spine 62 also includes a transverse shaft 66 that is coupled towards a bottom portion of the spine, and a latch member 74 extending transversely from the vertical spine's bottom, at a location below the shaft 66. Rotatably coupled to the transverse shaft 66 is a lower wheel 70 that has a channel, or groove, 72 that runs along its periphery so as to define a concave contact surface for the lower wheel 70.

As shown in FIG. 7, the transverse shaft 66 is perpendicular to the plane of the panel 12, which is generally received within a straight groove, or channel, 31. It is noted that, although the groove 31 is shown in the figures only with respect to the vertical side portion 20 (see FIG. 7), the other parts of the frame 14, i.e., vertical side portion 22, horizontal top portion 16, and horizontal bottom portion 18 also have corresponding grooves, or channels, for receiving respective edges of the panel 12.

The spine 62 connects to a mounting bracket 68 by attachment means, such as, for example, screws or bolts 77, through the vertical slot 64. The mounting bracket 68, in turn, couples to the back side of the vertical side portion 20 using screws or similar attachment means 79. As shown in FIGS. 5 and 7, the mounting bracket 68 has an upper horizontal flap 69 that accommodates a vertically-oriented, adjustable safety screw 75.

In operation, the height of the vertical spine 62 (and, therefore, the height of the door 10) can be adjusted by moving the spine 62 up or down, and then fastening to the mounting bracket 68 at the desired location. Once the height has been set, the safety screw 75 is then adjusted such that its bottom rests on the top surface 67 of the spine 62, thereby preventing any vertical movement of the lower wheel 70 during use.

In preferred embodiments, the lower track 100 includes a convex longitudinal (rail) portion 102 that mates with the lower wheel's concave channel 72. In addition, a concave channel 104 defined by the underside of the convex longitudinal portion 102 provides a surface for engaging the latch member 74. Thus, the latch member 74 slidably engages the channel 104 such that, as the lower wheel 70 rotates on the outer side of the convex longitudinal portion 102, the door 10 remains latched to the lower track 100.

Figures 8A, 8B, 8C:
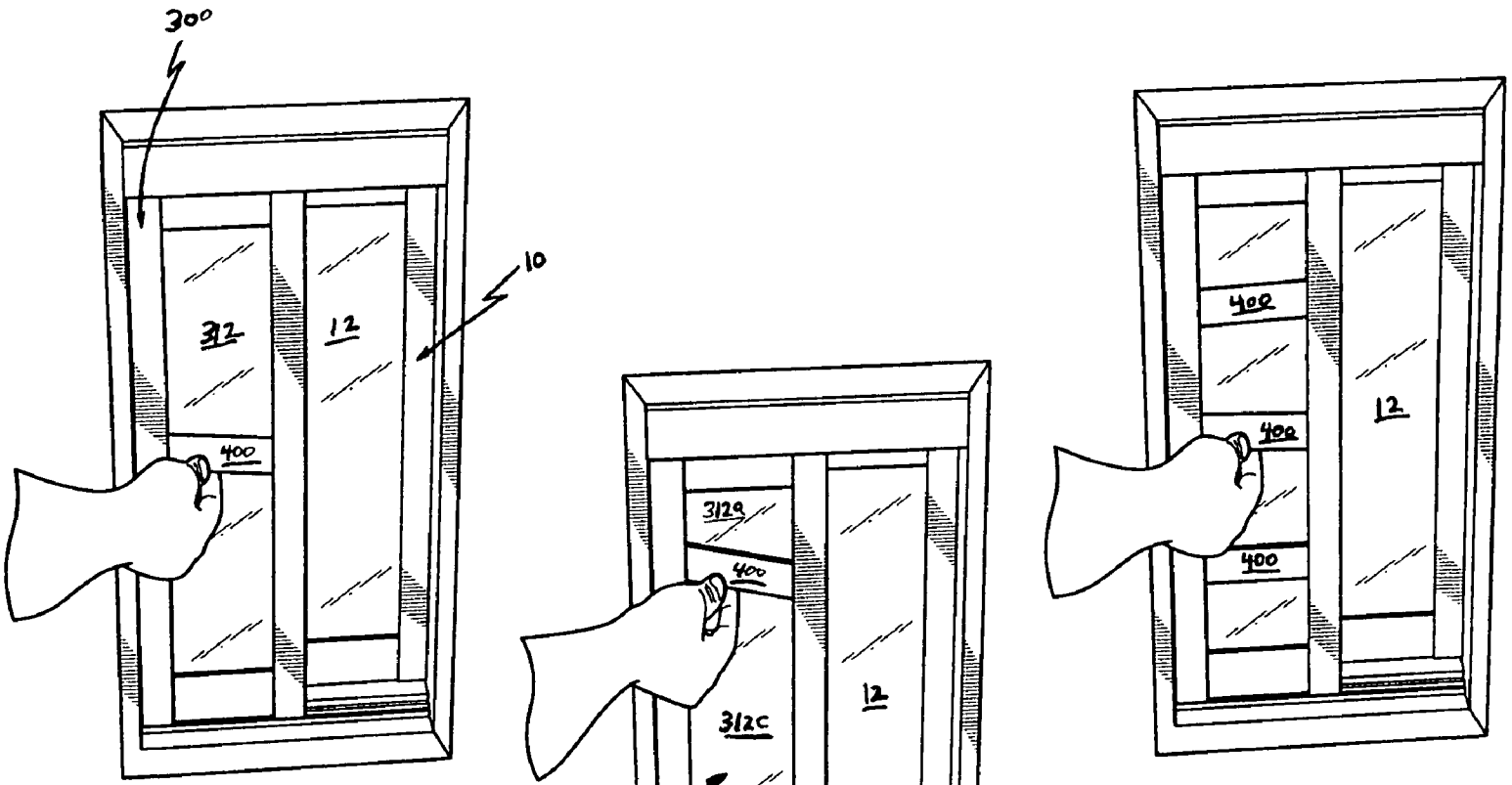
FIGS. 8A-8C show various design aspects of a sliding door system according to an embodiment of the invention.

As noted previously, existing sliding doors allow little to no flexibility in panel design. As shown in FIGS. 8A-8C, however, an aspect of the instant invention is to provide divider strips 400 that may be removably attached, e.g., via double-sided tape, to the panel 12, 312. Thus, for example, in FIG. 8A, a single divider strip 400 is attached to the panel 312 so as to provide the appearance of two separate (i.e., upper and lower) panels. Similarly, in FIG. 8B, two dividers are used, and in FIG. 8C, three dividers are used to provide an appearance, respectively, of three and four separate panels.

It is noted that, because the dividers 400 can be placed anywhere on the panel, the resulting appearance can be asymmetrical, if such asymmetry is desired. Thus, for example, in FIG. 8B, the top and bottom portions 312*a*, 312*b* are smaller than the middle portion 312*c*. In addition, the dividers may be placed on the panel 12, 312 horizontally, vertically, diagonally, and/or in a combination of orientations. For example, a panel may include a "T" configuration on the bottom, and an inverted "T" configuration on top, etc.

While the description above refers to particular embodiments of the present invention, it will be understood that modifications may be made without departing from the spirit thereof. For example, although the figures depict, illustratively, an upper track 200 with two channels 210, 310, the upper track 200 may include as few (e.g., a single one), or as many, channels as may be needed to implement the invention. Similarly, although the lower track 100 is shown, illustratively, to accommodate either one or two doors 10, 300, the lower track 100 may be made so as to accommodate one or more doors, depending on the intended use and the area to be covered by the door(s).

For example, when a single door is to be used, the upper track 200 may include a single channel 210, and the lower track 100 may include a single convex longitudinal portion 102 to support the lower wheel assembly 60. On the other hand, when two doors are to be used, the upper track 200 may include two channels 210, 310, and the lower track 100 may include two longitudinal portions 102, 302.

In addition, the same configuration may be used when more than two doors are necessary. Thus, for example, when four doors are to be used, each of the channels 210, 310, and each of the longitudinal rails 102, 302 may accommodate two doors, and the doors may slide between the upper and lower tracks in alternative positions. That is, the first and third doors may be accommodated by the first channel and longitudinal portion, and the second and fourth doors may be accommodated by the second channel and longitudinal portion. Alternatively, the first and fourth doors may be accommodated by the first channel and longitudinal portion, and the second and third doors may be accommodated by the second channel and longitudinal portion. Other similar configurations may also be used, as necessary.

The accompanying claims are therefore intended to cover such modifications as would fall within the true scope and spirit of the present invention.

What is claimed is:

1. An interior sliding door system comprising:

(a) an interior, non-hanging, sliding door having a panel that is encased within a frame, wherein said frame comprises a horizontal top portion, a horizontal bottom portion, and opposing first and second vertical side portions, said door further including first and second upper roller assemblies respectively disposed proximate opposing ends of said horizontal top portion, a first lower wheel assembly coupled to said first vertical side portion only, and a second lower wheel assembly coupled to said second vertical side portion only, wherein each of said first and second lower wheel assemblies comprises:

(1) a vertical spine having a vertical slot through a central portion thereof and a transverse shaft coupled to a bottom portion thereof, said transverse shaft being disposed perpendicular to the plane of the panel;

(2) a mounting bracket that is configured to be coupled only to a back side of a respective one of said first and second vertical side portions via attachment means selected from the group consisting of screws, bolts, and combinations thereof, said mounting bracket being detachably coupled to the vertical spine through said vertical slot so as to allow vertical adjustment of the spine with respect to the bracket;

(3) a lower wheel that is rotatably coupled to said transverse shaft and has a channel along the periphery thereof so as to define a concave contact surface; and (4) a transverse latch member disposed vertically below said lower wheel and parallel to said transverse shaft;

(b) a lower track having a convex longitudinal portion that is configured to mate with said lower wheel's concave channel so as to allow the lower wheel to matingly rotate on the outer side of the convex longitudinal portion, said transverse latch member slidably engaging a concave channel defined by the underside of said convex longitudinal portion so as to slidably latch each said lower wheel assembly to the lower track as the lower wheel rotates on said convex longitudinal portion; and (c) an upper track configured to receive said upper roller assembly so as to allow the door to slide horizontally between said lower and upper tracks.

2. The interior sliding door system of claim 1, wherein each of the first and second upper roller assemblies includes first and second rubber rollers rotatably mounted on respective first and second vertical shafts so as to be of substantially equal height, wherein:

(a) the first shaft is disposed adjacent a front side of the frame such that the first roller's periphery extends beyond the plane of the frame's front side;

(b) the second shaft is disposed adjacent a back side of the frame such that the second roller's periphery extends beyond the plane of the frame's back side; and (c) each of the rubber rollers has a horizontal middle section, a top side, and a bottom side, said top and bottom sides being of substantially equal diameter and said middle section having a diameter that is larger than the diameter of the top and bottom sides.

3. The interior sliding door system of claim 2, wherein said upper track defines a channel having first and second opposing side walls that respectively extend downwards over, and parallel to, the front and back sides of the frame's horizontal top portion, such that at least the middle section of said first roller rotates in frictional contact with a surface of said first side wall and at least the middle section of said second roller rotates in frictional contact with a surface of said second side wall.

4. The interior sliding door system of claim 1, further including at least one divider strip that is removably attached to the panel's front side.

5. The interior sliding door system of claim 1, wherein the panel is made of a member selected from the group consisting of clear glass, milky glass, frosted glass, mirror, and combinations thereof.

6. The interior sliding door system of claim 1, wherein said lower and upper tracks are disposed within a wall cavity so as to allow the sliding door to extend out from, and retract into, said cavity.

7. The interior sliding door system of claim 1, further including a second interior, non-hanging, sliding door, wherein the second sliding door comprises a second pair of lower wheel assemblies and a second pair of upper roller assemblies, and each of the upper roller assemblies includes two rollers.

8. The interior sliding door system of claim 7, wherein the upper track includes a first channel to receive the rollers of the first door's upper roller assemblies and a second channel adjacent and parallel to said first channel to receive the rollers of the second pair of upper roller assemblies, the lower track includes a second convex longitudinal portion adjacent and parallel to said first convex longitudinal portion, and each of said second pair of lower wheel assemblies has a lower wheel that matingly rolls on the second convex longitudinal portion.

9. The interior sliding door system of claim 8, wherein each of said second pair of lower wheel assemblies further includes a latch member that engages the underside of the second convex longitudinal portion so as to slidably latch the second sliding door to the lower track.

* * * * *